United States Patent [19]

Chase

[11] 4,046,997

[45] Sept. 6, 1977

[54] DIGITAL-STORAGE FILTER

[75] Inventor: Paul Herbert Chase, East Granby, Conn.

[73] Assignee: Combustion Engineering, Inc., Windsor, Conn.

[21] Appl. No.: 683,442

[22] Filed: May 4, 1976

[51] Int. Cl.[2] ..... G06J 1/00

[52] U.S. Cl. ..... 235/150.5; 325/42; 328/167

[58] Field of Search ..... 235/150.5, 152, 156; 343/5 DP, 10; 328/167; 325/42, 65

[56] References Cited

U.S. PATENT DOCUMENTS

| | | | |
|---|---|---|---|
| 3,146,343 | 8/1964 | Young | 235/150.5 |
| 3,441,720 | 4/1969 | Lazecki | 235/150.5 |
| 3,622,765 | 11/1971 | Anderson | 235/150.5 X |
| 3,789,199 | 1/1974 | Kotwicki | 235/150.5 |
| 3,894,219 | 7/1975 | Weigel | 235/150.5 |

*Primary Examiner*—Joseph F. Ruggiero
*Attorney, Agent, or Firm*—Joseph H. Born

[57] ABSTRACT

An apparatus is disclosed for realizing analog signal filters with very long time constants. In order to avoid the losses inherent in conventional energy-storage devices such as capacitors and inductors, an analog signal is converted into digital form for storage, thereby eliminating losses, and the digital quantity is continuously converted back to analog form for use in the analog circuit.

5 Claims, 6 Drawing Figures

DIGITAL-STORAGE FILTER

BACKGROUND OF THE INVENTION

Applications exist in which a system quantity to be monitored is characterized by relatively rapid changes that represent no useful information to the operator of the system. In those applications, the operator is only interested in long-term trends in the monitored quantity, and the rapid changes only serve to confuse the operator. An example of this is the brightness meter used in a recovery boiler. The brightness meter output is recorded on a strip-chart recorder, which may have a speed of around 1 inch per hour, and the trends to be detected develop over a range of, say 1 to 2 hours. However, the output of the brightness meter, responding to variations in the shifting char bed, undergoes oscillations having periods of 10 to 20 minutes. These oscillations put confusing information onto the strip chart, and effective use of the strip-chart readout requires a great degree of interpretation.

In applications of this type and in others in which only long-term trends are of interest, it would be desirable to have a filter follow the sensor output so that only the useful information is displayed to the operator. However, filters for such applications would have long time constants, and realization of long-time-constant transfer functions is complicated by the fact that the energy-storage devices, principally capacitors, that conventional realizations call for are subject to levels of leakage that become significant when used in long-time-constant circuits.

SUMMARY OF THE INVENTION

It is therefore an object of the present invention to provide a filter that eliminates short-term variations in the output of a signal source. Another object is to provide an apparatus for use in the realization of long-time-constant filters that eliminates the loss problem encountered in conventional circuits.

According to the present invention, analog signals are converted by a periodically triggered analog-to-digital converter whose output is continuously reconverted to analog form. The analog signal at the input to the analog-to-digital converter is thereby preserved from period to period with zero loss. By means of positive feedback from the output of the digital-to-analog converter to the input of the analog-to-digital converter, zero-loss storage through an indefinite number of periods can be obtained.

DETAILED DESCRIPTION OF THE INVENTION

Figure 1:
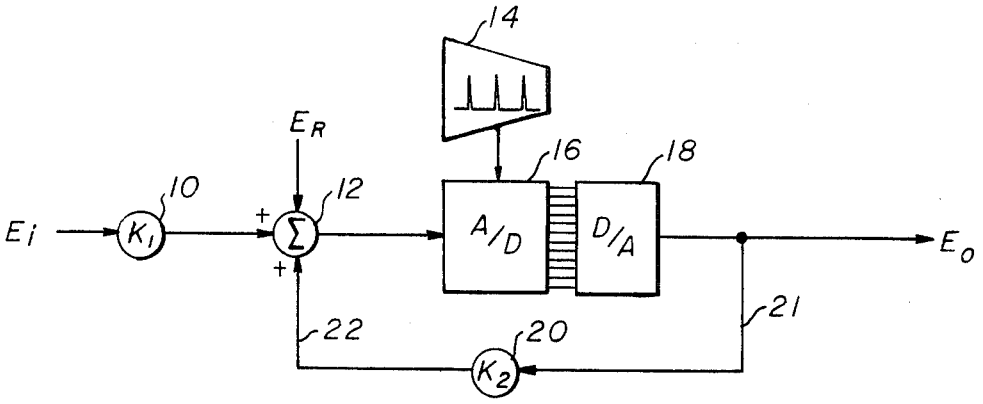
FIG. 1 is a block diagram of a low-pass filter employing the present invention.

In FIG. 1, the filter input signal, $E_i$, is multiplied by $K_1$. This function is represented by element 10. Element 20 performs a similar function, multiplying its input by $K_2$. The results of the operations represented by elements 10 and 20 are added, a function represented by element 12. Actual hardware capable of performing the functions of multiplication and addition represented by elements 10, 12, and 20 is well known to ordinarily skilled practitioners of the art, so elements 10, 12 and 20 represent whatever circuits the practitioner chooses to perform these functions. It would not be atypical for all these functions to be performed by one amplifier. Together, elements 10, 12 and 20 constitute a means for producing a signal at its output port equal to the sum of a first quantity, $K_1E_i$, proportional to signals, $E_1$, occurring at its first input port, a second quantity, $K_2E_o$, proportional to signals, $E_o$, occurring at its second input port, and a constant, $E_R$. The ordinarily skilled practitioner will appreciate that, while the signal lines indicate only one output terminal on summing circuit 12, a terminal at a potential common to all the analog devices, probably ground, is assumed and not shown. Thus, the term port, which usually means a pair of terminals, is used in the claims that describe these elements. Of course, common terminals are not an essential part of the invention, so an embodiment that does not have its signals referenced to ground could nonetheless fall within the teachings of the present specification.

Pulse generator 14, which is a means for generating trigger signals, triggers analog-to-digital converter 16 at regular intervals. In order to afford flexibility, pulse generator 14 will ordinarily be a variable-period device. The combination of pulse generator 14 and analog-to-digital converter 16 is a means for maintaining at its output terminal a digital representation of the signal occurring at its input port at the most recent of a series of discrete times. Each time analog-to-digital converter 16 receives a trigger signal from pulse generator 14, it converts the output of summing circuit 12 to a digital signal and maintains that digital signal at its output terminals until it receives the next trigger signal from pulse generator 14. Digital-to-analog converter 18 continuously produces at its output terminals an analog representation of the output of analog-to-digital converter 16. This signal, which is the device output, is fed back to elements 20 and 12.

To illustrate the operation of this device, $E_i$ is assumed to be a unit step, the step occurring between $t_0$ and $t_1$, where $t_0, t_1, t_2, \ldots,$ and $t_n$ are times at which successive trigger signals from pulse generator 14 occur. Assuming that $E_R$ is zero and that at $t_0$ the output of digital-to-analog converter 18 is zero, then zero volts will be the input to analog-to-digital converter 16, and $E_o$ will have a value of zero as a result. Between $t_0$ and $t_1$, $E_i$ changes from zero volts to 1 volt, and at $t_1$ a trigger signal is generated by pulse generator 14. Since the feedback input to summing circuit 12 is zero at $t_1-$, the output of summing circuit 12 is $K_1E_{i1}$, where $E_{in}$ is the value of $E_i$ at $t_n$. This value is converted to digital form by analog-to-digital converter 16 at $t_1$. The output of converter 16 is immediately converted back to analog form by digital-to-analog converter 18, and the output $E_o$ of the filter between times $t_1$ and $t_2$ is equal to $K_1E_{i1}$. At time $t_2$, $E_i$ will have changed from $E_{i1}$ to $E_{i2}$, so the inputs to summing circuit 12 are $K_1E_{i2}$ and $K_1K_2E_{i1}$. Therefore, $E_{o2}=K_1E_{i2}+K_1K_2E_{i1}$. Our assumption that $E_i$ is a unit step function implies that the expression for $E_{o2}$ simplifies to $(K_1+K_1K_2)$(1v.). Repeated applications of this process will show that $E_{on}=K_1(1+K_2+K_2^2+\ldots+K_2^{n-1})$(1v.). As $n$ approaches infinity, the value of $E_{on}$ converges for $0<K_2<1$:

$$\lim_{n\to\infty} E_{on} = \frac{(K_1)}{(1-K_2)} \text{ (lv.)} \tag{1}$$

Figure 2:
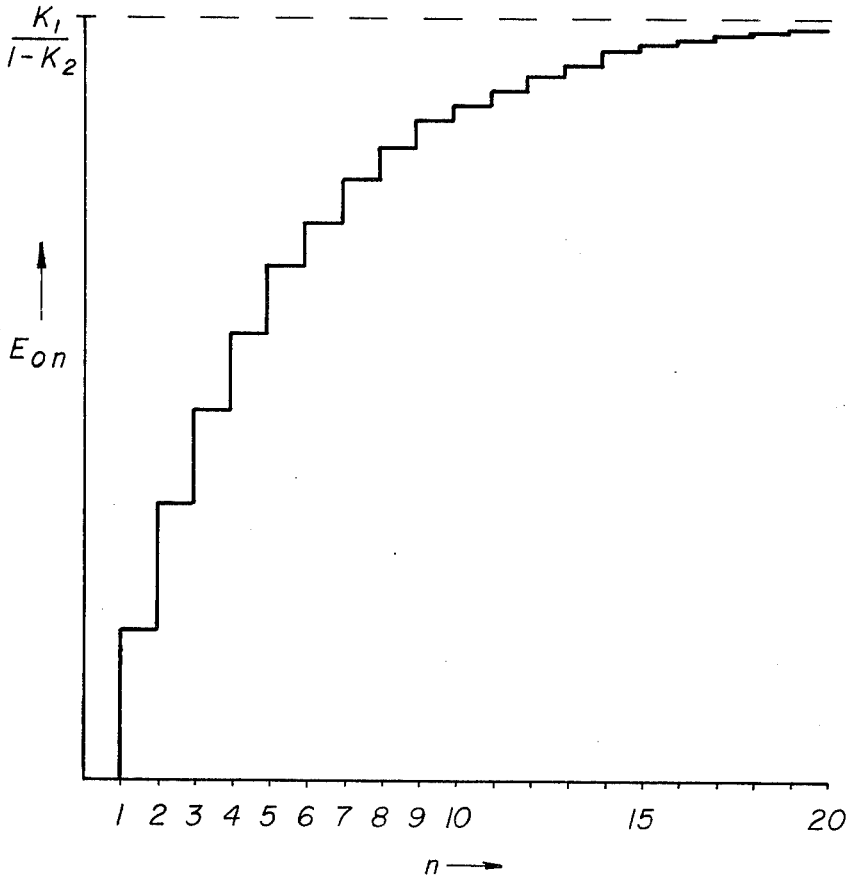
FIG. 2 is a graph of the step response of the filter of FIG. 1.

The values of $E_{on}$ are plotted in FIG. 2 as a function of $n$, and it can be seen that the function is a discrete-time version of the classic response of a single-pole low-pass filter to a unit step, $$E_o(t) = 1 - E^{-t/\tau} \tag{2}$$

Remembering that in the response of a single-pole low-pass filter to a unit step the time constant is the reciprocal of the initial slope, we can see that the quantity corresponding to $\tau$ is equal to the pulse period multiplied by the ratio of the limit of $E_o$ to the amplitude of the output step occurring at $t_1$, or $$\tau = T\cdot\frac{K_1}{1-K_2} \div K_1 = \frac{T}{1-K_2}, \tag{3}$$

where T is the period of pulse generator 14. It is thus apparent that the filter has a time constant determined by the period of pulse generator 14 and the gain represented by element 20 and that the filter has a gain that is determined by the gains represented by elements 10 and 20.

It is to be noted that the device has an infinite time constant when $K_2$ is unity. This fact indicates that, while the device of the present invention finds its primary and intended use as a brightness-meter output filter, its range of potential uses is much wider. With $0<K_2<1$ as in the above discussion, the device functions as a low-pass filter. For $K_2=1$, the invention is an integrator. For $K_2>1$, the invention acts as an exponential-function generator in response to a one-period pulse. In addition to the functions that the device can accomplish by itself, it can also function as a constituent element in larger filters, as one skilled in the art can appreciate from the fact that it can be used as an integrator.

Figure 3:
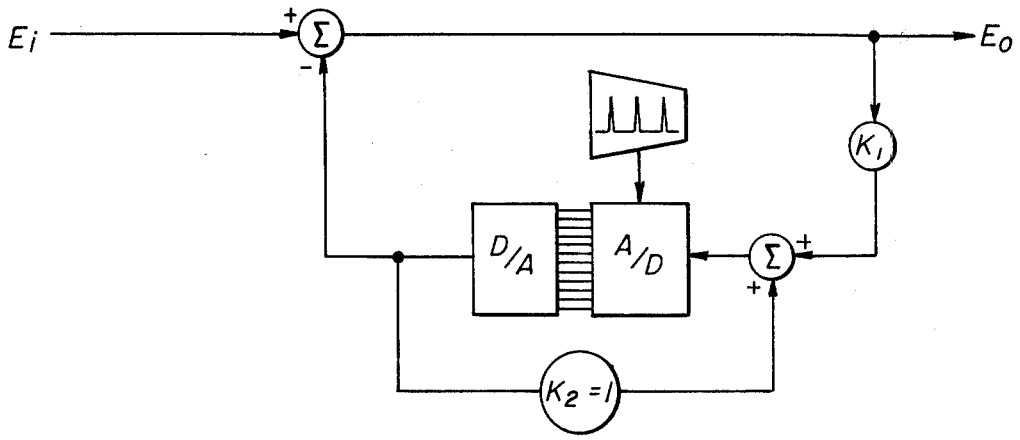
FIG. 3 is a block diagram of a high-pass filter employing the present invention.

For example, if one were to substitute the present invention with $K=1$ in the place of the integrator in the typical analog-computer realization of a high-pass filter, the circuit of FIG. 3 results. Following the signals at successive trigger times after a unit step between $t_0$ and $t_1$ in the method previously employed results in an output of the filter at time $t_n$ given by $$E_{on} = (1-K)^n(1v\cdot),\ n\geqq 1. \tag{4}$$

Figure 4:
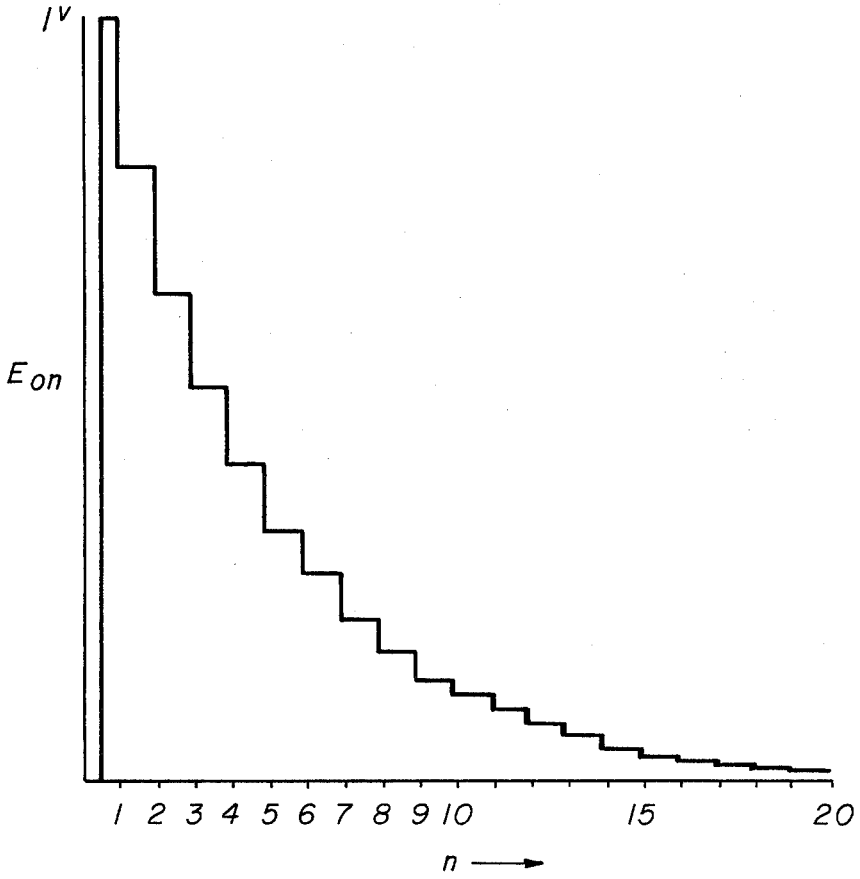
FIG. 4 is a graph of the step response of the filter of FIG. 3.

As can be seen in the graph in FIG. 4, the output of the high-pass filter is a discrete version of a classic exponential decay, the type of decay that characterizes a single-pole high-pass filter. Again, the time constant can be derived from the initial-slope method used in equation (3):

$$\tau = T\cdot 1 \div K_1 = (T/K_1). \tag{5}$$

It will be noted that the value of $K_1$ was assumed to be 0.20 in both graphs. This number was chosen for ease of presentation. Ordinarily, $K_1$ would be smaller, since $K_1$ determines the height of the "steps" in the plot, so a relatively small value of $K_1$ produces a relatively smooth response. It does not follow, however, that ever smaller values of $K_1$ produce ever improving results. A practical constraint on the value of $K_1$ is that a small value of $K_1$ results in a large amount of quantization error. For example, if it is assumed that the analog-to-digital converter 16 of FIG. 1 is a 12-bit unit and has a range of 5 volts, then it will have a resolution of approximately 1.2 millivolts. As a result, because $E_i$ is reduced by a factor of 5 by element 10, a change in $E_i$ of 6 millivolts would be required to guarantee a change in the output of the filter. In other words, the size of the "dead zone" resulting from quantization error is multiplied by the reciprocal of $K_1$. Accordingly, in designing filters of this type, it is necessary to effect a trade-off between the smoothness of the response to large steps and the effect of the quantization error resulting from the digital storage.

As was previously observed, the ordinarily skilled practitioner of the art will have at his command a variety of readily available devices that can be used as the elements of the storage device of the present invention, and it is the purpose of the claims to include all realizations of the present invention that include these available elements. Toward this end, the following observation is made.

The invention is described in black-box representations in which the boxes segregate functions in a manner that lends itself easily to explanation. The practitioner will find, however, that the available devices do not necessarily segregate these functions in the same manner as the representations in FIGS. 1 and 3. For instance, a tacit assumption of the preceding calculations was that the combination of the analog-to-digital and the digital-to-analog conversions results in a gain of unity; this assumption restricts the amplification function to the combination of elements 10, 12, and 20. Of course, this is not a necessary characteristic of such converters. In fact, some combinations of available devices, in addition to resulting in non-unity gains, would also translate the analog input by a constant voltage. It is not the purpose of the present disclosure to present methods of adapting to the present invention converters that depart from the zero-gain assumption, since such methods are straight-forward applications of ordinary design skill. However, the embodiment of FIG. 5 is offered as an example of a type of realization that falls within the scope of the present invention.

Figure 5:
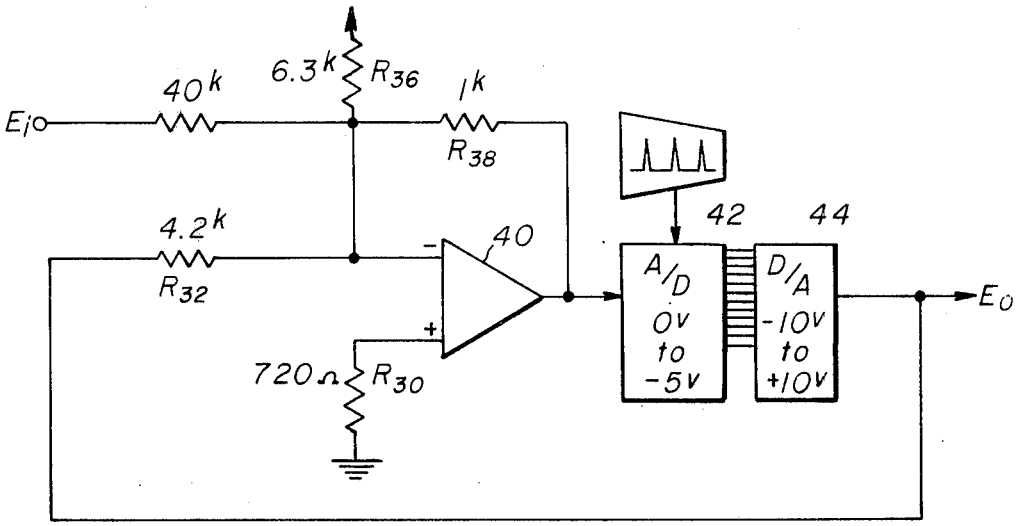
FIG. 5 is a simplified schematic diagram of one form of the low-pass filter of FIG. 1.

In FIG. 5, amplifier 40 and resistors R30, R32, R34, R36, and R38 together constitute a network that combines the functions represented by elements 10, 12 and 20 in FIG. 1. Amplifier 40 is a differential amplifier with a reference ground applied to its plus terminal through R30, a 720-ohm resistor. The output of amplifier 40 is fed back through R38, a 1-kilohm resistor. $E_i$ is applied to the negative terminal of amplifier 40 through R34, a 40-kilohm resistor. This results in a gain for $E_i$ or $-1/40$. $E_o$ is applied to the negative input of amplifier 40 through R32, a 4.2-kilohm resistor, and this results in a gain for $E_o$ of $-19/80$. R36, a 6.3-kilohm resistor, is tied to a 15-volt source and applied to the negative input terminal of amplifier 40, lowering its output by $2\frac{3}{8}$ volts. As a result, the output of amplifier 40 is the negative of the sum of 1/40 $E_i$ plus 19/80 $E_o$ plus $2\frac{3}{8}$ volts. This output is fed to analog-to-digital converter 42, which is a 12-bit device with an input range of 0 to −5 volts. The digital output of analog-to-digital converter 42 is applied to the input terminals of the digital-to-analog converter 44, which is a 12-bit converter with an output range of −10 volts to +10 volts. Converters 42 and 44 in FIG. 5 correspond to converters 16 and 18 of FIG. 1, respectively.

The device of FIG. 5 contemplates an input signal $E_i$ with a range of 0 to 10 volts and a recorder at the device output with an input range of −10 to +10 volts. In other words, a steady-state $E_i$ of zero volts should result in an output signal $E_o$ of −10 volts in order to cause the recorder to mark at the low end of its range. When $E_i$ has a steady-state value of +10 volts, then the output, $E_o$, should be +10 volts in order to cause the recorder to mark at the upper end of its range. That this result actually occurs can be verified by following an input signal through the filter.

Assuming that $E_i$ is initially at zero volts, the output of amplifier 40 will be the negative of the sum of 1/40 of $E_i$, which is zero, plus 19/120 of 15 volts, which is $2\frac{3}{8}$ volts, plus 19/80 of $E_o$. Assuming that $E_o$ is where we expect it to be for a steady-state $E_i$ of zero, we have an $E_o$ of −10 volts, 19/80 of which is $-2\frac{3}{8}$. Thus, the output of 40 is zero, which is the output of amplifier 40 if our assumption about $E_o$ is correct. We note that analog-to-digital converter has a range of zero to −5 volts, rather than −5 volts to zero, which means that the high end of the analog input range, namely zero, will result in a digital representation at the low end of the digital range, namely zero. This results in a zero input for digital-to-analog converter 44, resulting in a −10-volt output, which was our assumption. Accordingly, we see that the device has the intended characteristics that a steady-stage input of zero results in a steady-state output of −10 volts.

We now assume a 10-volt step in $E_i$ between times $t_0$ and $t_1$. Immediately after this step and before $t_1$, the inputs to amplifier 40 are the same as they were at $t_0$, with the exception that $E_i$ has increased by 10 volts. Since the $E_i$ value is attentuated by a factor of 40, this results in a one-fourth-volt change in the output of amplifier 40, meaning that at $t_1$ the output of amplifier 40 is −one-fourth volt. A one-fourth-volt change is a movement of 1/20 of the 5-volt range of analog-to-digital converter 42, and its digital representation reflects this result at $t_1$ plus one convert time. Accordingly, the output of digital-to-analog converter 44 also changes by 1/20 of its range, resulting in an $E_o$ of −9 volts between $t_1$ and $t_2$. This 1-volt change from −10 volts to −9 volts is fed back to amplifier 40 through R32, and 19/80 of it appears at the output of amplifier 40 between $t_1$ and $t_2$. Succeeding pulses increase $E_o$ until it has reached a steady-state value of 10 volts (or as close to 10 volts as quantization error permits). That +10 volts is the steady-state value of $E_o$ can be seen by assuming a 10-volt $E_o$ and a 10-volt $E_i$. Given these assumptions, the output of amplifier 40 is the negative of the sum of 19/80 of $E_o$ + 1/40 of $E_i$ + $2\frac{3}{8}$ volts. This results in a −5-volt output of amplifier 40. This is the low end of the input range of analog-to-digital converter 42. Consequently, converter 42, which has a 0-to-minus-5-volt range (rather than a minus-5-to-0-volt range), has an output that is a digital representation of the upper end of its range. This input triggers an output in digital-to-analog converter 44 at the upper end of its range, namely, 10 volts, confirming the original assumption. From the foregoing it can be seen that the device of FIG. 5 is a low-pass filter with a gain of 2 and an additive constant of −10 volts. In addition, calculations similar to those performed previously show that the filter has a time constant of 20 pulse periods.

It is not to be wondered at that the reader may find the correspondence between the FIG. 5 embodiment and the block diagram of FIG. 1 to be rather obscure. Accordingly, a more mathematical discussion of this operation will be undertaken with the aid of FIG. 6, a block-diagram representation of FIG. 5.

Figure 6:
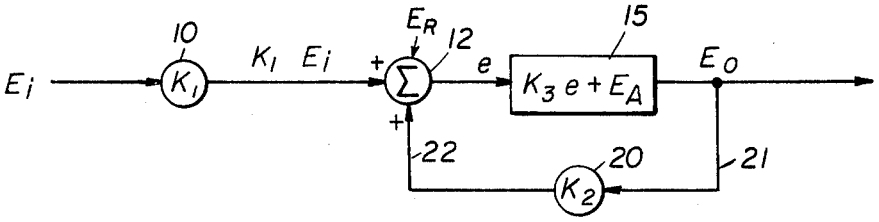
FIG. 6 is an alternate block diagram of the filter of FIG. 5.

The elements of FIG. 6 function in the same manner as the corresponding elements in FIG. 1. The only difference between the diagrams is element 15. Element 15 has a function similar to the combination of elements 14, 16, and 18 of FIG. 1. The difference is that it is not assumed that the signal at the output port of element 15 immediately following a trigger signal is in general the same as the signal entering element 15 immediately before the trigger signal. The signal leaving element 15 is in general an additive constant plus a factor times the signal in, or $$E_{on} = K_3 e_n + E_A \tag{6}$$

It will be recognized that the embodiment of FIG. 1, for which $E_{on} = e_n$, is a special case of (6) in which $K_3 =$ and $E_A = 0$. It can be shown that $E_o$ has a steady-state value of $$E_o = \frac{E_A + K_3 E_R}{1 - K_2 K_3}, \; 0 \leqq K_2 K_3 < 1, \tag{7}$$

when $E_i = 0$. As a practical matter, then, $E_R$ is chosen to result in the desired quiescent value of $E_o$. A discussion similar to that employed in deriving (1) shows that a response to a unit step results in $$E_{on} = K_2^n K_3^n \cdot \frac{E_A + K_3 E_R}{1 - K_2 K_3} + \sum_{m=o}^{n-1} [K_2^m K_3^m E_A + K_2^m K_3^{m+1}(\text{lv.})].$$

As $n$ approaches infinity, the value of $E_{on}$ converges for $0 \geqq K_2 K_3 \geqq 1$:

$$\lim_{n \to \infty} E_{on} = \frac{E_A + K_3 E_R + K_1 K_3(\text{lv.})}{1 - K_2 K_3} \tag{8}$$

Equations (7) and (8) and our expression for $E_{on}$ show that the step response is a function that starts at $E_A + K_3 E_R / 1 - K_2 K_3$, approaches $(E_A + K_3 E_R)/(1 - K_2 K_3 + (K_1 K_3(\text{lv.})/(1 - K_2 K_3)$, and takes an initial step of $K_1 K_3(\text{lv.})$, which is $(1 - K_2 K_3)$ of the way between the initial value and the approached value. Following the logic of equation (3), this gives a time constant of $$\tau = T \cdot \frac{K_1 K_3}{1 - K_2 K_3} \div K_1 K_3 = \frac{T}{1 - K_1 K_3} \tag{9}$$

That this FIG. 6 arrangement actually works on the same principle as the FIG. 1 arrangement can be seen by redefining variables:

(10)

-continued $$K_1' \underset{=}{(\Delta)} K_1 K_3 \tag{11}$$

$$K_2' \underset{=}{(\Delta)} K_2 K_3 \tag{12}$$

$$E_{on}' \underset{=}{(\Delta)} E_{on} - \frac{E_A + K_3 E_R}{1 - K_2'}$$

These result in a new statement of the step response: $E_{on}' = K_1'(1 + K_2' + K_2'^2 + \ldots + K_2'^{n-1})$ and a new statement of (8), $$\lim_{n \to \infty} E_{on}' = \frac{K_1'}{1 - K_2'} \tag{8a}$$

an equation that bears a striking resemblance to (1). Equation (9) is similarly transformed to $$\tau = T \cdot \frac{K_1'}{1 - K_2'} \div K_1' = \frac{T}{1 - K_2'}, \tag{9a}$$

an equation reminiscent of (3).

This discussion accordingly shows that the circuit of FIG. 5 follows the teachings of the present invention despite the addition of a constant by the hardware and despite the fact that the analog-to-digital-to-analog conversion section does not have a gain of unity. It also falls within the scope of the present invention although the functions of elements 10 and 20 cannot be segregated into separate components. Accordingly, the claims include an element that represents any combination of elements, like elements 10, 12 and 20 of FIG. 1, that has an output that is the weighted sum of $E_o$, $E_i$, and an additive constant. An example of such an element is amplifier 40 of FIG. 5 with its associated resistors.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the scope of the appended claims.

What is claimed is:

1. A storage device for receiving a device input and processing it to produce a device output comprising:

a. a digital-to-analog converter, having an output port and a plurality of input terminals;

b. means, having an input port, for maintaining a digital representation of a signal occurring at its input port at the most recent of a series of periodically occurring discrete times as an input to the terminals of the digital-to-analog converter, the signal at the output of the digital-to-analog converter thereby being equal to $$K_3 e + E_A,$$

where $K_3$ is a first constant, $e$ is the input, at the most recent of the discrete times, to the means for maintaining a digital representation, and $E_A$ is a second constant; and c. means having an output port and first and second input ports, the output port being connected to the input port of the means for maintaining a digital representation, the first port receiving the device input, and the second input port being connected to the output port of the digital-to-analog converter, for producing a signal at its output port equal to the sum of a first quantity proportional to signals occurring at its first input port, a second quantity proportional to signals occurring at its second input port, and a third constant.

2. A storage device as recited in claim 1 wherein $$0 < K_2 K_3 < 1,$$

where $K_2$ is the ratio of the second quantity to the output of the digital-to-analog converter.

3. A storage device as recited in claim 2, wherein the means for maintaining a digital representation comprises:

a. means for generating periodically occurring trigger signals; and b. an analog-to-digital converter that receives the trigger signals and has an input port constituting the input port of the means for maintaining a digital representation and maintains at the input terminals of the digital-to-analog converter a digital representation of the analog signal occurring at the analog-to-digital converter input port at the time of the most recent of the trigger signals.

4. A method of processing an analog input signal, comprising the steps of:

a. producing an error signal equal to the sum of a first quantity proportional to the input signal and a second quantity proportional to a feedback signal;

b. storing a digital representation of the value of the error signal at the most recent of a series of periodically occurring discrete times; and c. producing the feedback signal by continuously generating an analog version of the digital representation, the digital representation also being an output signal, the output signal thereby being equal to $$K_3 e + E_A,$$

where $K_3$ is a first constant, $e$ is the error signal, and $E_A$ is a second constant.

5. A method as recited in claim 4 wherein:

$$0 < K_2 K_3 < 1,$$

where $K_2$ is the ratio of the second quantity to the feedback signal.

* * * * *

UNITED STATES PATENT OFFICE

CERTIFICATE OF CORRECTION

PATENT NO. : 4,046,997

DATED : September 6, 1977

INVENTOR(S) : Paul Herbert Chase

It is certified that error appears in the above-identified patent and that said Letters Patent are hereby corrected as shown below:

Column 3, line 18, change "$E_0(t)=1-E^{-t/\tau}(2)$" to --$E_0(t)=1-e^{-t/\tau}$ (2)--.
Column 4, line 62, change "or" to --of--.
Column 6, line 28, after "$K_3$ =" insert --1--.
Column 6, line 46, change "$0 \geq K_2K_3 \geq 1$:" to --$0 \leq K_2K_3 < 1$:--.
Column 6, lines 53 and 54, change "$E_A+K_3E_{R/}1-K_2K_3$" to --$(E_A+K_3E_R)/(1-K_2K_3)$--.
Column 6, line 55, after "(lv.)" add --)--.
Column 6, line 68, delete "(10)".
Column 7, line 2, insert --(10)-- at the end of the line.
Column 8, line 9, after "first" insert --input--.

Signed and Sealed this

*Sixth* Day of *February 1979*

[SEAL]

*Attest:*

RUTH C. MASON
*Attesting Officer*

DONALD W. BANNER
*Commissioner of Patents and Trademarks*